United States Patent [19]

Katz et al.

[11] Patent Number: 4,939,888

[45] Date of Patent: Jul. 10, 1990

[54] METHOD FOR PRODUCING A MASS DISTRIBUTABLE PRINTED PACKET

[75] Inventors: Robert E. Katz, Florham Park; John H. Jones, Westfield; Frederick Grainger, Greenbrook; Donald W. Schoenleber, Belle Mead; George P. Hipko, Milltown; Patrick J. Donahue, Belle Mead; Stanford Silverschotz, Livingston, all of N.J.; James Hoffman, Doylestown, Pa.

[73] Assignee: Webcraft Technologies, Inc., N. Brunswick, N.J.

[21] Appl. No.: 360,040

[22] Filed: Jun. 1, 1989

[51] Int. Cl.[5] ..... B65B 35/50; B65B 61/02; B65B 61/20

[52] U.S. Cl. ..... 53/411; 53/131; 53/157; 53/435; 53/447; 53/520

[58] Field of Search ..... 53/411, 435, 447, 131, 53/520, 513, 531, 540, 157, 466, 266 A

[56] References Cited

U.S. PATENT DOCUMENTS

| | | | |
|---|---|---|---|
| 4,071,997 | 2/1978 | Gunther, Jr. et al. | 53/520 X |
| 4,189,895 | 2/1980 | Volkert et al. | 53/520 X |
| 4,455,809 | 6/1984 | Dallaserra | 53/435 |
| 4,769,969 | 9/1988 | Minami | 53/520 X |
| 4,790,119 | 12/1988 | McDaniels | 53/411 |

*Primary Examiner*—James F. Coan

*Attorney, Agent, or Firm*—Shlesinger & Myers

[57] ABSTRACT

A method for producing a mass distributable printed packet is disclosed wherein a web of paper has printed thereon a format of successive rectangular pieces in a plurality of longitudinal lines extending parallel to the edges of the web, the web is cut longitudinally between the print patterns and the thus-formed strips are superposed in vertical registry of the printed patterns. The superposed strips are then cut to form sets of printed pieces which sets are each placed within an individual outer container.

27 Claims, 6 Drawing Sheets

METHOD FOR PRODUCING A MASS DISTRIBUTABLE PRINTED PACKET

FIELD OF THE INVENTION

This invention relates to a method for producing a mass distributable packet, and particularly to a packet having a multi-piece paper insert set produced by in-line printing, marking, and collating techniques, and capable of being packaged by machine insertion and in-line wrap methods.

BACKGROUND OF THE INVENTION

Mass distributed advertising pieces have been increasingly used by advertisers to sell their products. The distribution of these pieces, whether by mail or by insertion in newspapers or magazines, has become an effective advertising practice.

In many mailings, the advertising material is personalized by adding the name of the person who is to receive the material. For example, mailings to members of associations, or other groups such as credit card holders, or selected types of customer groups, have included personalized solicitation letters. Often, one or more other types of pieces, such as two page advertising inserts, or an order blank, or return envelope, are also included in the mailing.

These additional pieces have increased the effectiveness of the promotion. The additional pieces, although adding versatility to the advertiser promotion, frequently require additional manufacturing steps which can add significantly to the cost of producing the advertising item.

This is particularly true for advertising packets. These items have very many, usually small individual pieces, such as redemption coupons. Production requirements such as collating of the multiple pieces in a common set, as well as packaging the set using existing production techniques usually will make the unit price too high for a cost effective mass distributable advertising piece.

It has not been possible to effectively personalize or to mark the pieces of such a packet. There is a need for this capability, since it will make it possible to direct a promotion to specific individuals or to a given market segment to maximize response to the promotion. In terms of the advertising dollar, the higher response rate will justify a higher unit cost for the item.

SUMMARY OF THE INVENTION

Accordingly, this invention is directed to making a printed packet having a large number of insert pieces for a relatively low unit cost.

The invention is also directed to providing an ability to determine the effectiveness of an advertising promotion by providing an identification or tracking capability for all of the pieces of the set, and linking them with the recipient of the packet, to determine the effectiveness of an advertising promotion.

The method of this invention adapts in-line printing techniques to the production a complete multi-piece insert set which can readily be mechanically processed. It is also possible to simultaneously mark for personalized identification of any or all the pieces of the set. The printed pieces can also be directly collated as a part of the in-line production method.

With this in-line the packet can be made with less equipment. There is no possibility of mistakes in collating personalized pieces, encountered with ordinary collating methods.

Also, the in-line method of forming sets of pieces, and the addition of a separator allows commercially available envelope insert equipment to be used without major equipment adjustments.

The in-line production is achieved by multiple piece inserts printing a web in such a way that the set of pieces are printed as a unit in a common print repeat or a submultiple thereof. This is also possible with multiple webs where many different types of pieces make up the set. The pieces that are to make up each set are printed in a particular relationship with respect to each other to fix the ultimate position of each piece in the assembled in-line collated insert set.

A specific single and distinct common identification number or marking is jet imaged on the printed pieces of each set contained on the web to particularly identify the recipient and an advertising item. The insert pieces can be marked by visual printed imaged marking, or by a laser-produced hole pattern. The markings are correlated and identifiable with an imaged name of a recipient on the envelope or on one of the pieces.

The laser pattern is normally undetectable to the eye. Both such markings are positioned on the piece to provide and capable of being machine reading capability. Consequently, the mass-distributed advertising pieces on their return can readily be machine processed to obtain the marketing acceptance data of interest to the advertiser.

When commercially available envelope insert feeder equipment is to be used, individual sets of insert pieces have an end separator sheet. It is engaged along with its associated set of pieces, and machine separated from the other sets. The equipment used for separation is commercially available equipment ordinarily used only for individual sheet processing.

These and other objects and advantages of the invention will be readily apparent in view of the following description and drawings of the above described invention.

DESCRIPTION OF THE INVENTION

Figure 1:
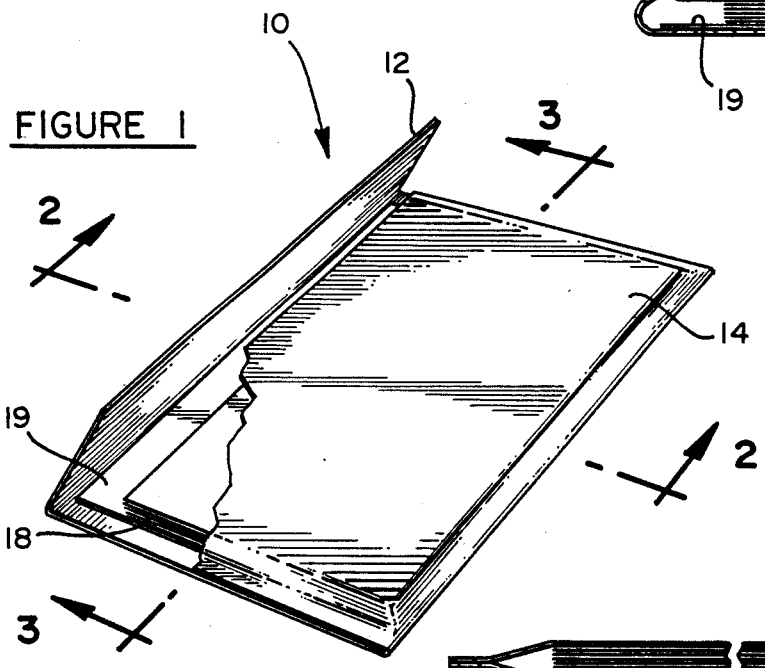
FIG. 1 is a perspective view of an insert packet showing an envelope containing a set of machine inserted printed insert pieces.
Figure 2:
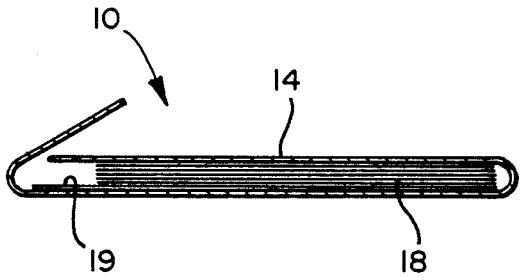
FIG. 2 is a cross-section along line 2—2 of FIG. 1.
Figure 3:
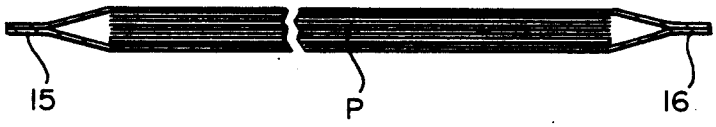
FIG. 3 is a cross-section along line 3—3 of FIG. 1.
Figure 4:
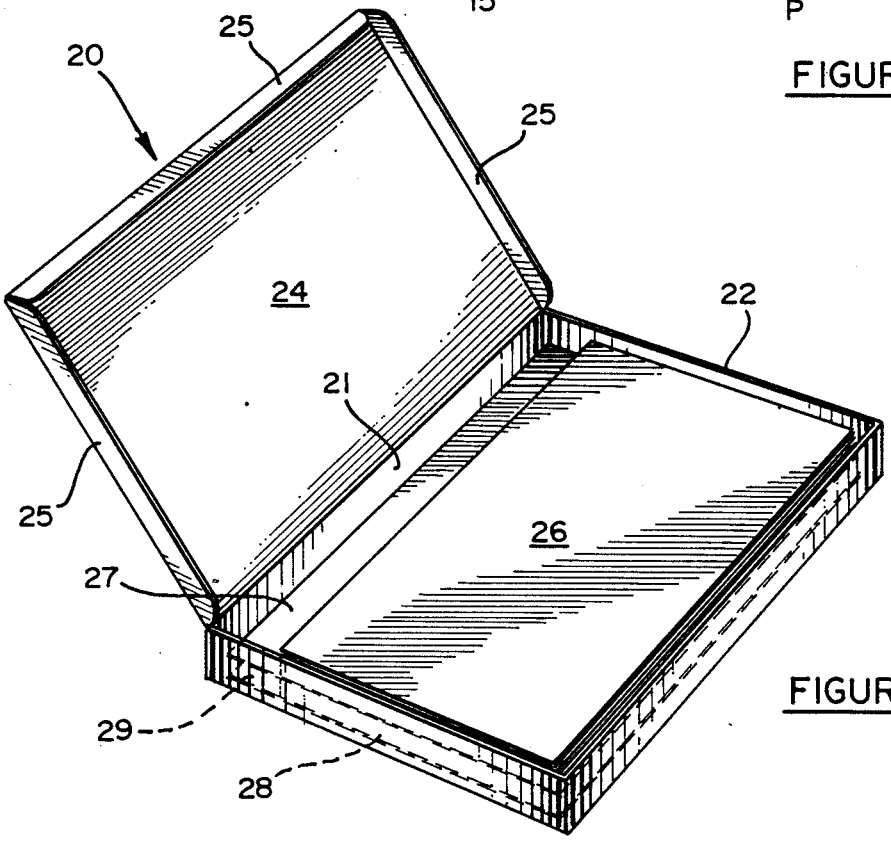
FIG. 4 is a perspective view of another packet arrangement, showing a small cardboard box containing two sets of machine handled printed pieces.

The mass distributed packet of this invention has an inner multiple piece insert set which is contained in an outer envelope, such as shown in FIG. 1, or a container flat box configuration, shown in FIG. 4. The packet consists of a set of paper sheets or pieces, which can either be a single sheet or folded item, return envelope or booklet. The set can have up to 30 single sheet items, or that thickness where multiple fold items are used. The single sheet items can be coupons or order blanks, while the folded items include personalized letters or folded advertising pieces. The set is contained within a paper envelope or folder, or within a paper or plastic wrap.

Referring particularly to the drawings, FIG. 1 shows an envelope, generally indicated at 10, having a flap 12 and pocket 14 which contains a machine insertable set of printed sheets 18 and a machine engageable separating piece 19. The envelope is provided with a wide pocket section 14 with ample clearance space at the adhesively held edges 15 and 16. This is a well known three panel double fold in-line wrap envelope. However, sets of printed sheets are usable and insertable in commercial and in many different types of envelope configurations.

FIG. 4 shows a perspective view of carton-type rectangular container 20 which has long and short sides 21 and 22 and a fold over top 24 with edge flaps 25. Two mechanically assembled sets of printed pieces 26, 28 are shown in the container. The sets 26 and 28 are different and have separator tabs 27 and 29 respectively.

Figure 5:
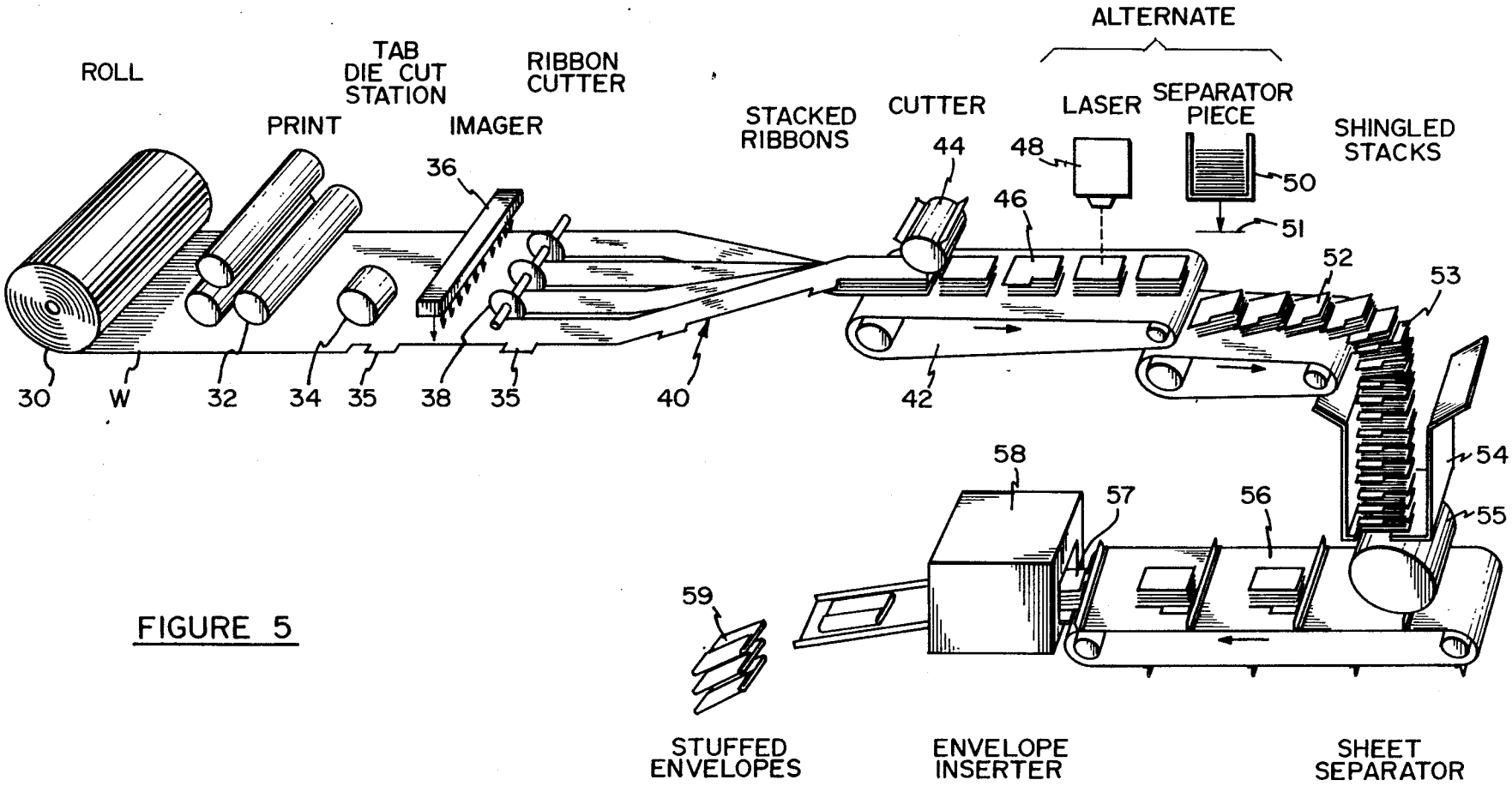
FIG. 5 is a schematic illustration of a method of manufacturing a machine insert containing packet.

The manner of manufacturing the completed packets and their corresponding machine insertable sets is schematically illustrated in FIG. 5.

A roll of web stock 30 supplies a web W of paper sheet stock to a high speed press 32, where the web is printed with the successive sets of printed pieces. Each set of printed pieces are printed as a group simultaneously in a print roll repeat or a submultiple thereof. A die cut trim section 34, trims an edge of the web, leaving one outwardly extending tab section 35 on what will be the same uppermost printed sheet of that set.

A jet imaging printing bar 36 images a personalized name or customer identification number on each printed piece of the set to identify a particular address or prospective customer or recipient to whom that set is to be sent. Each succeeding set of printed pieces receives its own different new individual customer name and corresponding identification number for that new set.

The web is subsequently split into plural ribbons by rotary slitter assembly 38. The ribbons are then brought into superposed relationship as indicated at 40. The superposed ribbons are cut by cutter 44 into individual sets 46, and then pass onto a conveyor 42. Succeeding printed pieces of the converged webs are simultaneously cut to provide multiple piece collated sets.

An alternate means of placing customer identification on the sets of printed sheets is shown at station 48, which is a laser assembly for producing small barely visible coded hole patterns which are simultaneously made through all of the paper sheets of the set. The coded customer identification hole markings are machine readable with scanning equipment. This marking arrangement for the sets of printed sheets can be used in some cases as an alternative to the imager number marking mentioned previously, or in conjunction therewith.

A possible alternative to die cutting a separator tab 35 is to run the sets under magazine 50 where a separator piece 51 is added as a top sheet of the set. The edge of this piece or the tab 35 will overlap and extend beyond the edges of the other aligned printed sheet pieces. A minimum of three eighths of an inch overlap is required. Alternatively, a common edge of all the pieces could be passed through a gluing stage where they could be glued together, providing a binding and a unitary pack.

Figure 7:
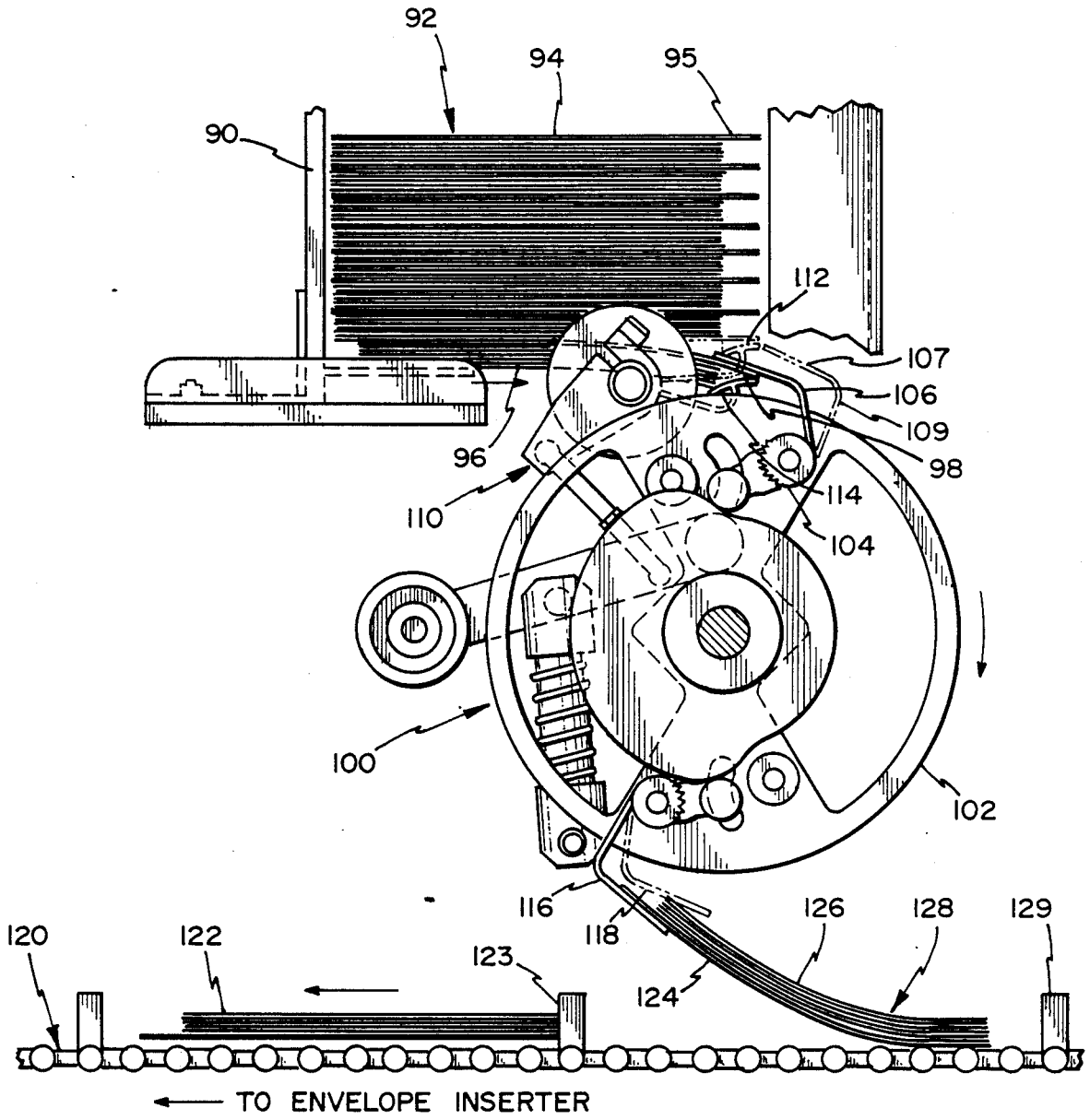
FIG. 7 is a side sectional view of a sheet feeder unloading successive stacked sets of insert pieces.

The sets are moved together at stop 53 (not shown) and into superposed relation and then dropped into the hopper 54. The stacked sets are then moved to the magazine of a sheet separator 55. The separator is shown here schematically in line. Details of the separator are shown in FIG. 7. The separator successively unstacks the sets to put them on a horizontal conveyor 56 which carries the set 57 to an envelope insertor 58 to produce the finished insert-stuffed envelope 59.

Figure 6:
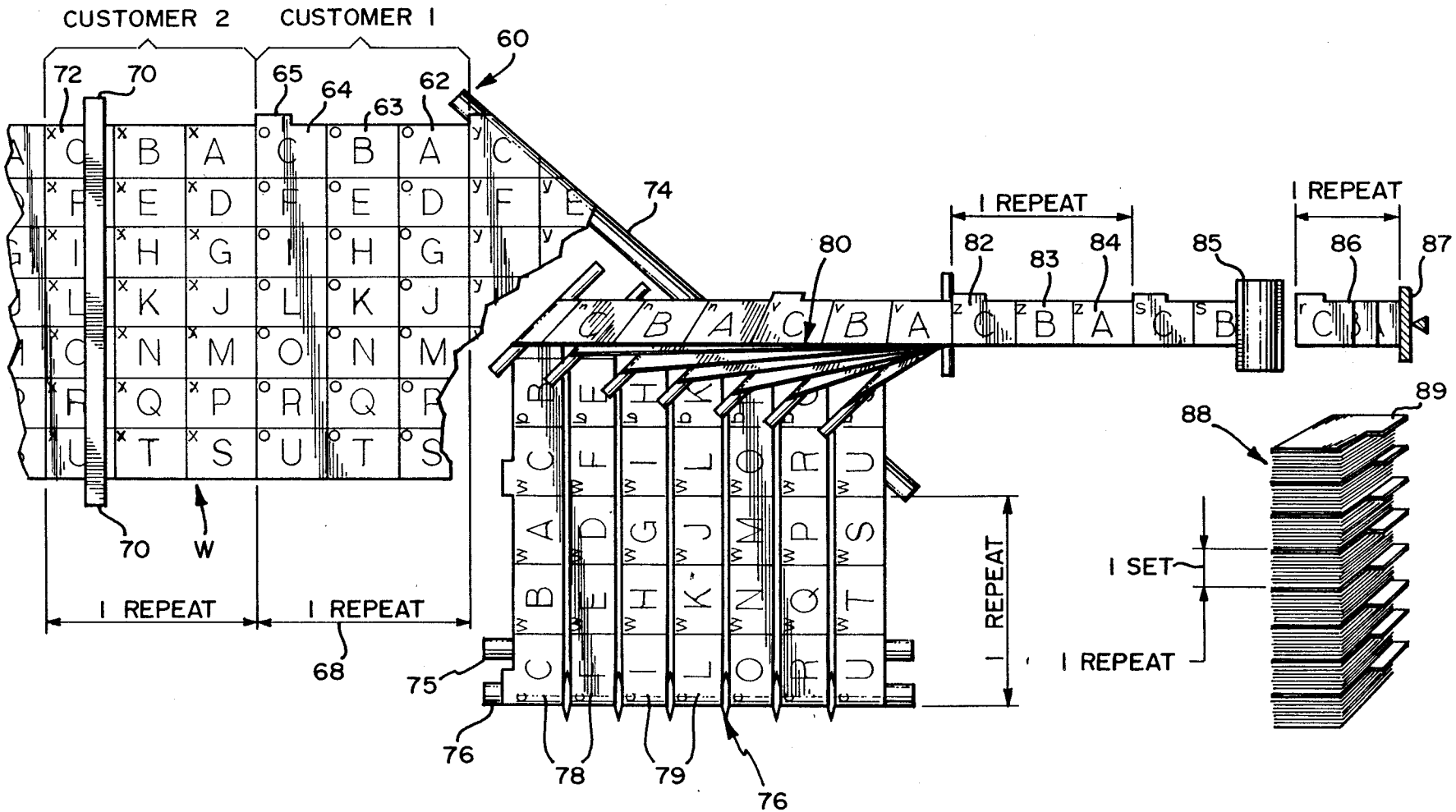
FIG. 6 shows a detailed web layout and schematic drawing of the progressive steps in assembling the sets of printed insert pieces.

A more detailed view of the arrangement of the web showing an arrangement of printed pieces and the manner in which they are brought together to form a set, is shown in FIG. 6. The web W has a repeat section generally indicated at 60, for customer #1, in which there is a layout of different printed coupons, A through U. As shown, each of the coupons are rectangular in shape and are the same size. An identical set of coupons is produced with each repeat of the press. If less coupons were desired, they could be printed as a submultiple of the repeat, or could be printed on narrower web stock. Note that coupons 62, 63 and 64 lettered A, B and C are successively printed in the first longitudinal line. A second subset of coupons D, E and F are printed immediately beside the first line and in registry with the coupons A, B and C. A similar arrangement is shown for the coupon subsets in longitudinal lines G, J, M, P and S. Note that the items designated for customer #1 constitute a single and full repeat. If less coupons or printed items were to be provided, the set could be printed in a submultiple of the single repeat, to provide two or more sets for each repeat.

The first longitudinal line of coupons headed by the coupon A as shown at 62, has both its edge, and the edge of the adjacent coupon B at 63, trimmed, so that coupon C shown at 64, is left with a tab section 65. The tab section 65 has sufficient width to provide an overhang which is engageable by the sucker rod of machine insert feeder equipment.

Note in the corner of all of the coupons for customer #1, the designation in the upper left hand corner of the customer identification code of "0", which represents the code customer number imprinted by the imager. The code designation "X" in the upper left hand corner of the next set of coupons for customer #2 designates a different imager imprinted number for the customer.

The coupons are laid out so that it is possible to place the imaged customer identification number on all of the printed pieces of the set contained in the repeat section 68.

The imager bar assembly of a mead jet imaging unit (not shown), generally indicated at 70 is positioned close to the web; due to the width of the web the assembly is usually two or three imaging bars wide. The bars are controlled separately, but are integrated to operate jointly. The imaging bar assembly places a coded customer identification number on each coupon piece. Note that the coupons in the transverse row 72 which have not as yet passed under the imager, do not have any designation.

In this case, for illustration purposes, coupons of the same size are shown. They all have different printed matter, and each one is coded with a specific number by the imager. There is also the probability that one or two of these pieces would be a different size, and at least one of them would be personalized with the name and address of the customer. The identification number would be coded to identify the individual designated in that repeat.

The web 60 passes over bay roller 74 and then passes transversely over the second roller 75. The web is cut by the rotary slitter assembly 76, along the edges of each longitudinal line of coupons, making side by side parallel separate ribbons, 78, 79. Each of these ribbons is then passed over its respective individually angled turn bar assembly and brought into vertical superposed arrangement as generally indicated at 80. Note that each of the top coupons 82, 83 and 84 are part of the first longitudinal ribbon constituting one full repeat. The ribbon misalignment due to travel length, is compensated for by compensating rollers (not shown) to bring all the underlying coupons into transverse alignment. In this case, all of the transverse coupon rows as originally printed on the web are brought into alignment. They are subsequently cut by the rotary cutter 85 into separate individual subsets of a transverse coupon row such as at 62 of coupons A, D, G, J, M, P, shingled over each other as indicated at 86. The subsets are then pushed together to make a full set by the pusher 87. Note there was assembled subsets in the FIG. 6 illustration, but only one successive set assembled in FIG. 5.

When the sets are dropped into a hopper, they form a stack as generally indicated at 88, with the outwardly extending separator tab coupon (C) 89 dividing the sets from each other. Each set is, because of the tab coupon, machine separable and constitutes one full repeat.

FIG. 7 shows the manner in which a stack of machine separable sets of printed pieces are mechanically separated from the stack by a slightly modified commercially available single sheet insert feeder, such as schematically (see sheet separator 55, in FIG. 5). This device is capable of separating a set as well as a single paper sheet because of the separator.

The vertical stack of separable sets, generally indicated at 92, is disposed in magazine 90. Each set 94 has plural printed rectangular pieces or sheets and a top machine separable sheet 95. The tab extends beyond the edge of the other sheets. The lowermost set in the magazine, indicated at 96, is in position to be removed when the overhanging section of its tab 95 is contacted by the vacuum operated pivoted sucker element 112 which pulls it downwardly toward the rotary drum gripper cylinder assembly 100. Note that the sucker should in most cases engage both the overhang or tab, and the adjacent sheet edges of the set to pull out the whole set.

The rotary drum element 102 rotates in a clockwise direction and has a gripper member 106 the rotation of which has been adjusted to come down upon and hold the entire lowermost set of printed pieces 96 and the top separator sheet 98 firmly against the rotating drum 102. When a set is grasped and held in this position, the rotating drum will pull the entire lowermost set of printed pieces 96 away from the stack and out of the magazine 90.

The gripper member 106 is a rotatable cam operated member. The gripper mounting piece 104 is a cam operated rotatable member which is timed to move backward and downward from the open position 107 to the closed set engaging position 106 by a rapid motion which moves it over the edge of the tab separator when the pivoted sucker rod reaches its low position 114. Note that the sucker rod assembly 110 is an individually pivoted assembly whose movement is synchronized with the movement of the rotary drum 102.

A second gripper element 118 at the lower side of the drum 102 provides the capability to remove two sets of printed pieces for each rotation of the drum. The gripper moves to its raised position 116 as it travels to the lower part of the drum releasing the set onto the conveyor 120. The previously deposited set of sheets indicated at 122, is moved by the pusher rod 123 along the conveyor 120. The separator piece 124 and sheets 126 of set 128 are released onto the conveyor when the gripper moves to position 116. The pusher 129 will then move it along the conveyor. These sets may also be dropped directly into small boxes (such as the boxes in FIG. 4) carried by the conveyor.

Figure 8:
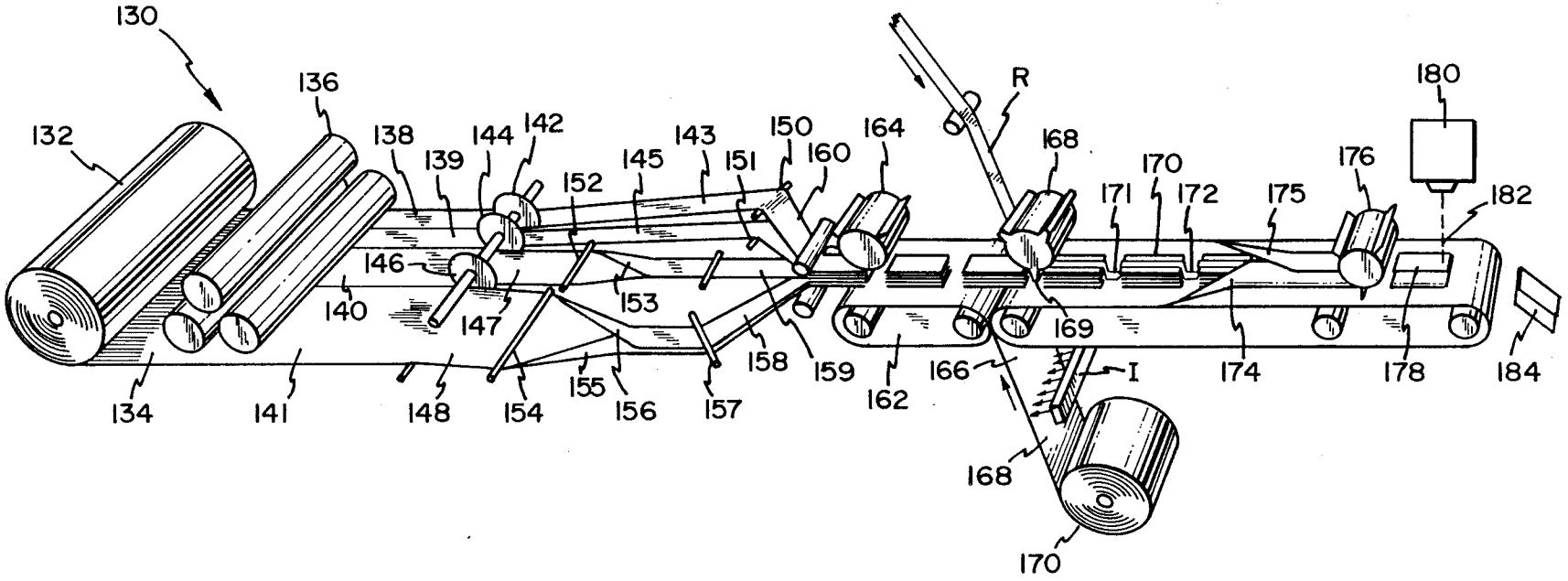
FIG. 8 shows a schematic illustration of a second method of manufacturing the packet, where sets are wrapped by an in-line process.

FIG. 8 is a schematic illustration of the method for producing both coupons, and also different types of insert pieces simultaneously in-line, which are then subsequently wrapped in-line after cutting to provide a finished piece.

The in-line continuous one pass system is generally indicated at 130. The roll 132 provides a paper web 134 which is passed through a rotary web press printing stage generally at 136. The layout on the web is such that the ultimate arrangement of the desired products, such as coupons, inserts, letters, or return envelopes are arranged on the web printing format such that the pieces can be imaged, folded, and superposed so that when they are cut as a group, the pieces will be in the desired order and arrangement they are to occupy in the finished printed set.

In this assembly, the printed format on the web has two coupon ribbons 138, 139, a two panel insert ribbon 140, and a double fold ribbon 141. The web is slit by rottary slitter disc 142 to produce the far end ribbon 143. The disc cutter 144 cuts off the adjacent longitudinally extending ribbon 145. The ribbons will be separated along the contiguous coupon edges. Ribbons 143 and 145 will each contain a series of single sheet coupons similar, but longer than those shown in the longitudinal lines of web W of FIG. 6.

Cutter 146 produces a wider ribbon 147, which subsequently passes over bar 152 and is folded at 153 to produce a series of single fold insert pieces for the set. The arrangement of all the pieces is in a common repeat. They are all in dimensional transverse edge alignment with pieces of adjacent lines in anticipation of the subsequent single cut to be made of all pieces in the superposed ribbons. This is taken into consideration in the initial web printing of the web.

The remaining longitudinal web 148 is a double fold insert, such as a letter. It passes under roller 154 and is folded successively at 155 and 156.

The ribbons 143, 145, and the folded ribbons 158 and 159 are converged to bring them into single superposed arrangement at 160 over conveyor 162. The superposed webs are cut by cutter 164 to produce single set of pieces 165. The sets 165 drops from conveyor 162 onto the wrapper web 168 which is supplied from roll 170. The wrapper web is imaged with the name and address of the recipient by the imager assembly I. This web will provide the outer wrap container for the set of previously processed pieces.

A hold down ribbon generally indicated at R, passes under a transverse crimp roller 168 which has an outwardly protruding transverse rubber pressure element 169. The ribbon has contact glue on its underside so that when it passes under the cross crimper roller 168, and is pressed against the web 166 by the cross crimping element 169, it adheres to the web at 171, 172.

In this manner, the loose set of pieces are held down by the ribbon section 170 which is adhered to the central portion of the wrap web 166 at 171 and 172 at either end of the packet. The circumference of the cross crimp roller 168 and the positioning of the cross crimp element 169 is such that the cross crimp element 169 will successively press the ribbon into contact with the wrap web at regularly spaced intervals, which is the distance between contact points 171 and 172. The web is then first folded over the held down packet at 174, and a second fold made at 175 to complete closing the insert pieces.

Since there are multiple sheet pieces in the set, a hold down arrangement is necessary. Also, the wrap is shown in the simplest form, omitting the glue strips that would previously be applied to the wrap web 168 before the sets 165 are brought into position. It might also be possible to add transverse glue lines to the wrap web at points corresponding to 171 and 172, as an alternative to having adhesive on the underside of ribbon R. However, this does introduce registry problems not encountered with the first described arrangement on the web.

As to securing the wrap web after folding, transverse glue lines, not shown, could be added to produce an envelope wrap format.

Several folding options not shown are available to produce a simple wrap format. However, with the introduction of several fold operations, the envelope container format can be modified to produce a low pocket long flap configuration, or if desired, a double pocket configuration, in which one of the pockets holds the inserts, while the second pocket is part of a return envelope. Appropriate glue strips can be applied to the web 168 prior to its receiving the packets 165 so that when the folds are made, the respective panels forming the pockets ar held in position. The cutter 176 cuts off the individual finished and wrapped packet 178.

None of the pieces in the finished packet, nor the packet itself, have been marked for tracking purposes with an imager. It is possible to simultaneously mark each of the pieces in the packet by passing it under laser 180 which produces a series of small coded hole patterns through both the wrapper and the packaged set. The hole pattern is unique and corresponds with the name and address printed on the outer wrap web 168 by the imager I. In this manner, all of the pieces in this set are marked with the same identification which corresponds to the name or the address of the recipient previously printed on the wrap web 168 by imager I. The holes are small, being approximately 7 thousands of an inch in diameter, and are machine readable. They are sufficiently small so that they will ordinarily not be noticed.

Since the holes are so small, they can be placed anywhere in the format at a desired position without interfering with visual reading of the printed material over which the hole pattern is made. The laser is a carbon dioxide laser, commercially available, which is modified to produce the hole patterns. An optical reader is used to read the hole patterns, with a preferably infrared light sensing assembly. Infrared gives better reading capability than ordinary white light because of the lower signal to noise ratio.

After it is marked, the completed packet 184 drops off the conveyor and is ready for packaging and shipment.

Figure 9:
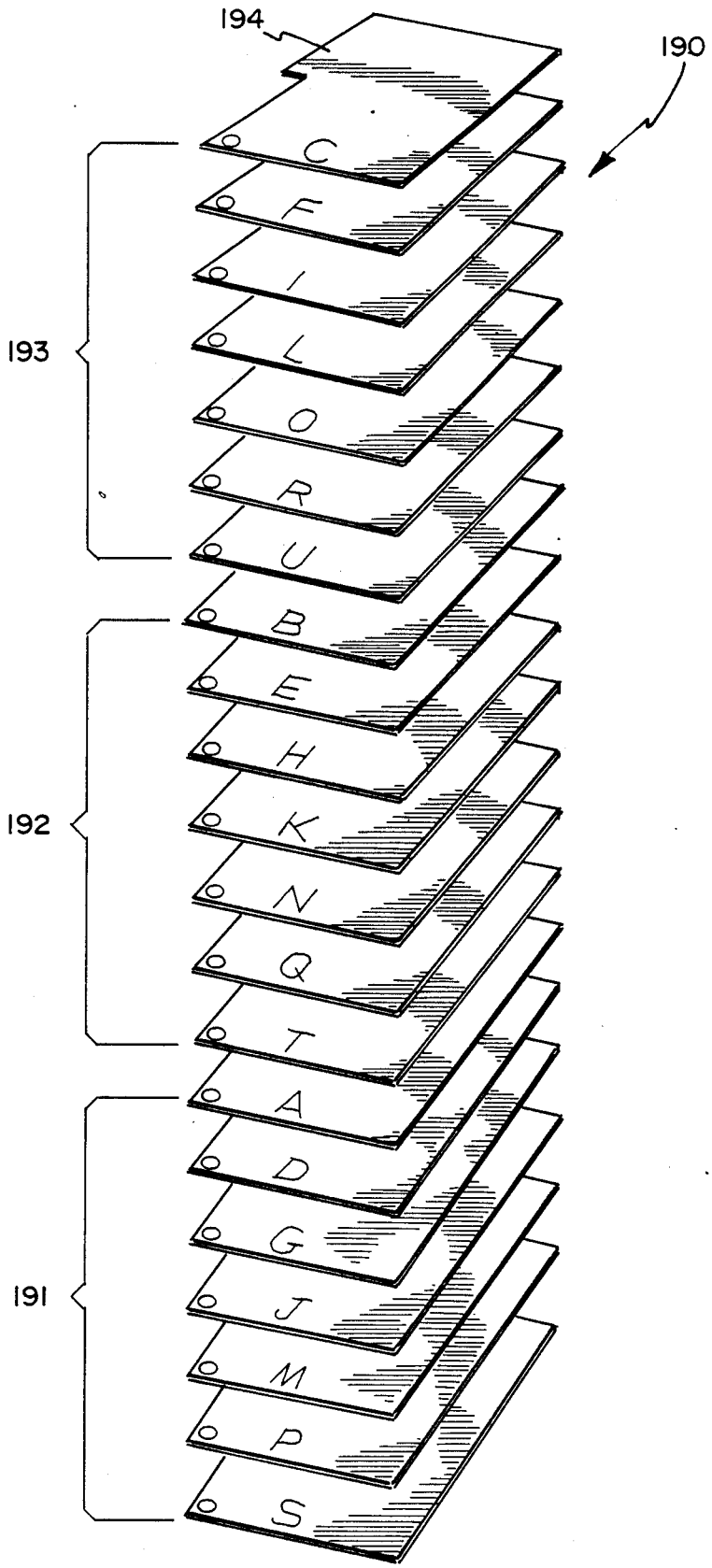
FIG. 9 is an exploded view of a stacked coupon set of the FIG. 6 repeat.

A perspective spaced view of the insert packet formed by the web layout and ribbon collation of FIG. 6, is shown in FIG. 9 at 190. The first transverse row of coupons 191 of the repeat 68 for customer No. 1 has coupons A, D, G, J, M, P and S. Each has the imaged customer identification number "0" at the corner thereof. The intermediate coupon grouping or subset 192 has coupon B, which was initially positioned in the first longitudinal row behind coupon A (FIG. 6, 63) at the head of the second transverse row. This row included coupons B, E, H, K, N, Q, and T. Lastly, the upper subset of coupons 193 with outermost and top sheet 194, is coupon C. This is the tab coupon which is engageable by the sucker rod and it performs the separator function between each set or group of successive coupons. As will be seen in FIG. 6, coupons C, 64, heads the last transverse row of coupons of the repeat for customer No. 1. The coupons in this row are C, F, I, L, O, R, and U.

The manner in which the subsets 191, 192, and 193 are positioned within the insert group 190, was discussed previously with respect to FIG. 6.

It should be noted that the tab on coupon C is only one modification of overhang that could be used.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention or the limits of the appended claims.

What is claimed is:

1. A method for producing a mass distributable printed packet, comprising the steps of:

(a) printing a format of successive rectangular pieces in a plurality of longitudinal side by side lines extending parallel to the edges of the web, the pieces of each line having the same longitudinal dimension and having their transverse edges in a fixed dimensional relationship with respect to pieces in adjacent longitudinal lines, the pieces being part of a common print repeat or a submultiple thereof, (b) separating the longitudinal lines of successive pieces along their respective side edges to form a plurality of individual longitudinal ribbons containing successive printed pieces, (c) superposing the separated longitudinal ribbons containing the different successive pieces with respect to each other such that the forward edges of the pieces in all of the superposed ribbons are in vertical registry with respect to each other, (d) cutting the superposed ribbons simultaneously along the forward edges of each of the pieces to obtain a common set having a single piece from each of the superposed ribbons, and (e) placing each set of pieces as a unit within an outer container.

2. The method for producing a mass distributable packet as set forth in claim 1, including the steps of:

(a) shingling at least two of the sets with respect to each other, and (b) subsequently pushing the sets together in vertical alignment to produce the final set to be placed in the outer container.

3. The method for producing a mass distributable packet as set forth in claim 2, including the step of:

(a) printing a set of insert pieces in a grid arrangement of different printed pieces arranged in two or more successive transverse rows.

4. The method for producing a mass distributable packet as set forth in claim 1, including the step of:

(a) imaging a distinct common marking on the insert pieces of a given set.

5. The method for producing a mass distributable packet as set forth in claim 4, including the step of:

(a) imaging the particular name of the recipient which corresponds with the common marking on at least one of the pieces of the set.

6. The method for producing a mass distributable packet as set forth in claim 1, including the step of:

(a) including a separator piece as an outer piece of each set which has a machine engageable separator section integral therewith.

7. The method for producing a mass distributable packet as set forth in claim 1, including the step of:

(a) producing a common coded machine readable marking on all of the pieces with a laser assembly which produces a hole pattern.

8. The method for producing a mass distributable packet as set forth in claim 7, including the step of:

(a) positioning the laser assembly above the assembled set of pieces to simultaneously produce the hole pattern through all of the superposed pieces of the set.

9. The method for producing a mass distributable packet as set forth in claim 1, including the steps of:

(a) including a separator piece having a machine graspable separator section as an outer piece of each set, (b) collecting successive sets in an aligned stack, (c) grasping the separator section of the end set of the stack and removing that set from the stack, and (d) placing each successive removed set of inserts in a receiving pocket of the container.

10. The method for producing a mass distributable printed packet as set forth in claim 1, including the steps of:

(a) placing the cut sets on an outer wrap web, (b) folding the outer wrap over the inserts to provide a holding packet for them, and (c) transversely cutting the outer web adjacent each end of the pockets to produce a plurality of insert containing packets.

11. The method for producing a mass distributable printed packet as set forth in claim 10, including the step of:

(a) placing a common identification marking on each of the pieces corresponding to a particular recipient, and (b) imaging the name of the recipient for the corresponding marked set on the section of the outer wrap which will contain the set with the corresponding marking.

12. The method for producing a mass distributable printed packet, comprising the steps of:

(a) printing a series of transversely aligned printed pieces within a common transverse section of a web print repeat as a common set, (b) separating the printed pieces of the common set from the web, (c) providing a machine engageable separator piece as an outer sheet of the set of pieces, (d) collecting and vertically aligning the edges of the pieces of the sets, (e) placing the sets in a vertically aligned stack, (f) separating the sets successively from the stack by engaging the separator piece and grasping the set to remove it from the stack, and (g) placing the sets in a container after removing them from the stack.

13. A method for producing a mass distributable printed packet as set forth in claim 12, including the step of:

(a) providing an integral outwardly extending machine engageable section with the outermost piece which will extend beyond the common edges of the pieces in the respective set.

14. A method for producing a mass distributable printed packet as set forth in claim 12, including the step of:

(a) placing a common marking on a plurality of the pieces of the set which identifies and correlates the set with a recipient.

15. The method for producing a mass distributable printed packet as set forth in claim 14, including the step of:

(a) producing the marking with an imager adjacent the web for placing a marking simultaneously on the pieces of the common transverse section of the web.

16. The method for producing a mass distributable printed packet as set forth in claim 14, including the step of:

(a) producing the marking with a laser which makes a common hole pattern simultaneously through all of the pieces of each set.

17. The method for producing a mass distributable printed packet as set forth in claim 12, including the step of:

(a) trimming the edge of the web to produce an outwardly extending tab on an outermot piece of the printed common set.

18. The method for producing a mass distributable printed packet as set forth in claim 17, including the step of:

(a) adding an oversize piece as the end piece for each set which has a machine engageable separator tab section.

19. The method for producing a mass distributable printed packet as set forth in claim 12, including the step of:

(a) inserting each set in a pocket which is part of the container.

20. The method for producing a mass distributable printed packet as set forth in claim 12, including the step of:

(a) wrapping a second web about each successive set which serves as the container.

21. The method for producing a mass distributable printed packet as set forth in claim 20, including the steps of:

(a) imaging the second web with a marking identifing a recipient, and (b) marking each of the pieces with a common marking corresponding to that recipient.

22. The method for producing a mass distributable printed packet as set forth in claim 12, including the step of:

(a) separating the successive sets from the stack with a sheet separator.

23. The method for producing a mass distributable printed packet as set forth in claim 22, including the step of:

(a) placing each set in an individual box which is the container.

24. The method for producing a mass distributable printed packet, comprising the steps of:

(a) printing a plurality of successive pieces on a web in plural longitudinally extending lines, (b) cutting the longitudinal lines from the web and arranging them in superposed relationship with the successive pieces in vertical registry with respect to each other, (c) cutting the superposed ribbons to obtain a purality of vertical aligned sets of successive pieces, (d) placing the sets on a wrap web, (e) holding the successive sets in fixed position on the web, (f) folding the web over the sets, (g) cutting the successive sets to provide a closed container, (h) cutting the wrap web between successive sets to provide a complete packet.

25. The method for producing a mass distributable printed packet as set forth in claim 24, including the step of:

(a) imaging the wrap web to identify the recipient, and (b) providing a marking on the pieces of the set which is correlated with the recipient.

26. The method for producing a mass distributable printed packet as set forth in claim 24, including the step of:

(a) holding the sets in position with a continuous ribbon which is affixed to the wrap web.

27. The method for producing a mass distributable printed packet as set forth in claim 24, including the step of:

(a) folding at least one of the ribbons to provide successive folded pieces.

* * * * *